US008978911B2

(12) United States Patent
Floyd et al.

(10) Patent No.: US 8,978,911 B2
(45) **Date of Patent: *Mar. 17, 2015**

(54) CONTAINER HAVING A HELICAL GRIP

(71) Applicant: The Procter & Gamble Company, Cincinnati, OH (US)

(72) Inventors: Brian Lee Floyd, Cincinnati, OH (US); Philip Edwin Hague, Chicago, IL (US); Jason Craig Campbell, Chicago, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/054,059

(22) Filed: Oct. 15, 2013

(65) Prior Publication Data

US 2014/0042119 A1 Feb. 13, 2014

Related U.S. Application Data

(63) Continuation of application No. 12/427,243, filed on Apr. 21, 2009, now Pat. No. 8,584,856, which is a continuation of application No. 11/049,070, filed on Feb. 2, 2005, now abandoned.

(60) Provisional application No. 60/554,261, filed on Mar. 18, 2004, provisional application No. 60/541,114, filed on Feb. 2, 2004.

(51) Int. Cl.

| | |
|---|---|
| ***B65D 23/10*** | (2006.01) |
| ***B65D 1/44*** | (2006.01) |
| ***B65D 1/02*** | (2006.01) |

(52) U.S. Cl.

CPC ..... *B65D 1/44* (2013.01); *B65D 1/0223* (2013.01); *B65D 23/102* (2013.01); *B65D 2501/0018* (2013.01); *B65D 2501/0081* (2013.01)

USPC ..... 215/384; 215/383; 215/398; 206/525; 220/755; 220/771

(58) Field of Classification Search

CPC ..... B65D 23/10; B65D 1/44

USPC ..... 215/382–384, 398; 220/675, 679, 755, 220/771; 206/525; D9/552

See application file for complete search history.

(56) References Cited

U.S. PATENT DOCUMENTS

| | | | | |
|---|---|---|---|---|
| 4,582,634 | A | 4/1986 | Sprecker et al. | |
| D319,183 | S * | 8/1991 | Halm | D9/552 |
| D386,401 | S * | 11/1997 | Prestia et al. | D9/552 |

(Continued)

FOREIGN PATENT DOCUMENTS

| | | |
|---|---|---|
| EP | 0460 765 B1 | 12/1991 |
| EP | 1 022 223 B1 | 7/2002 |

(Continued)

OTHER PUBLICATIONS

Non-Final Office Action for U.S. Appl. No. 12/427,243 dated Sep. 19, 2012, 7 pages.

(Continued)

*Primary Examiner* — Sue A Weaver
(74) *Attorney, Agent, or Firm* — Gary J. Foose

(57) ABSTRACT

Container having a helical grip translating down the container.

3 Claims, 3 Drawing Sheets

(56) References Cited

U.S. PATENT DOCUMENTS

| | | | | |
|---|---|---|---|---|
| 5,908,127 | A | 6/1999 | Weick et al. | |
| 6,112,925 | A * | 9/2000 | Nahill et al. | 215/382 |
| 6,228,317 | B1 | 5/2001 | Smith et al. | |
| 6,662,964 | B2 * | 12/2003 | Higuchi | 220/667 |
| 8,584,856 | B2 * | 11/2013 | Floyd et al. | 206/525 |
| 2005/0029220 | A1 * | 2/2005 | Onoda et al. | 215/382 |
| 2005/0209116 | A1 | 9/2005 | Edelman et al. | |
| 2006/0108318 | A1 * | 5/2006 | Chisholm | 215/382 |
| 2007/0051688 | A1 | 3/2007 | Dygert et al. | |
| 2009/0200193 | A1 | 8/2009 | Floyd et al. | |

FOREIGN PATENT DOCUMENTS

| | | | |
|---|---|---|---|
| FR | 1 408 275 | A | 8/1965 |
| FR | 1 551 812 | A | 12/1968 |

OTHER PUBLICATIONS

Notice of Allowance for U.S. Appl. No. 12/427,243 dated Mar. 27, 2013, 10 pages.

Notice of Allowance for U.S. Appl. No. 12/427,243 dated Jul. 15, 2013, 11 pages.

International Search Report for International Application Serial No. PCT/US2005/002800, mailed Jul. 25, 2005, 13 pages.

* cited by examiner

CONTAINER HAVING A HELICAL GRIP

FIELD OF THE INVENTION

The present invention relates to a container for containing a laundry product comprising a helical grip translating down the container, wherein the container has an opening. The present invention further relates to a container for containing a laundry product comprising a first helical grip and a second helical grip translating down the container, wherein the container has an opening.

BACKGROUND OF THE INVENTION

Containers are well known in the art. Such containers have been used for a multitude of products including chemical packages, food packages, cleaning packages, and the like. While such containers are well known in the art, there is still much to be desired from a consumer standpoint relating to usability.

A common problem plaguing most containers relates to holding and manipulating the container. There have been several attempts at making containers easier to manipulate. For example, handles are commonly attached to containers to improve their maneuverability. However, handles have the problem of adding significant additional costs, in addition to not being applicable to every container type due to process and manufacturing limitations.

Other containers have been developed that do not contain an outwardly protruding handle. Instead, these containers can be manipulated by grabbing the container at a narrowed portion of the container. Usually, this portion is near the top of the container. While this approach eliminates the need for a handle, thus eliminating production and materials cost, the container becomes increasingly difficult to maneuver, due to the smooth nature of most containers of this type.

Therefore, a need exists to provide a container that can be easily handled and maneuvered without excessive difficulty and can be made for a low cost.

SUMMARY OF THE INVENTION

The present invention relates to a container for containing a laundry product comprising a helical grip translating down the container, wherein the container has an opening. In one embodiment, the container is made from a plastic. In a more preferred embodiment, the plastic is selected from high density polyethylene, polymethylmethacrylate, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof. In an even more preferred embodiment, the plastic is polyethylene terephthalate. In still another embodiment, the plastic has a light transmission of at least about 70%.

In one embodiment, the container of the present invention has a volume from about 10 ml to about 5000 ml. In another embodiment, the container is formed by blow-molding. In one embodiment the helical grip contains a textured region. In another embodiment, the container has two helical grips. In yet another embodiment, the helical grip has a width from about 1 mm to about 15 cm.

In one embodiment, the container of the present invention further comprises a sealing mechanism functionally connected to the opening. In a more preferred embodiment, the sealing mechanism is selected from diaphragm valves, ball valves, slit valves, press taps, self-draining spouts, traditional spouts, divided spouts, screw caps, pull caps, snap caps, flip caps, vented caps, and combinations thereof. One type of cap is discussed in U.S. Provisional Application No. 60/581,907, hereby incorporated by reference.

The present invention also relates to a container for containing a laundry product comprising a first helical grip and a second helical grip translating down the container, wherein the container has an opening. In one embodiment, the container is made from a plastic. In a more preferred embodiment, the plastic is selected from high density polyethylene, polymethylmethacrylate, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof. In an even more preferred embodiment, the plastic is polyethylene terephthalate. In still another embodiment, the plastic has a light transmission of at least about 70%.

In one embodiment, the container of the present invention has a volume from about 10 ml to about 5000 ml. In another embodiment, the container is formed by blow-molding. In one embodiment the helical grip contains a textured region. In another embodiment, the container has two helical grips. In yet another embodiment, the helical grip has a width from about 1 mm to about 15 cm.

In one embodiment, the container of the present invention further comprises a sealing mechanism functionally connected to the opening. In a more preferred embodiment, the sealing mechanism is selected from diaphragm valves, ball valves, slit valves, press taps, self-draining spouts, traditional spouts, divided spouts, screw caps, pull caps, snap caps, flip caps, vented caps, and combinations thereof.

DETAILED DESCRIPTION OF THE INVENTION

Figure 1:
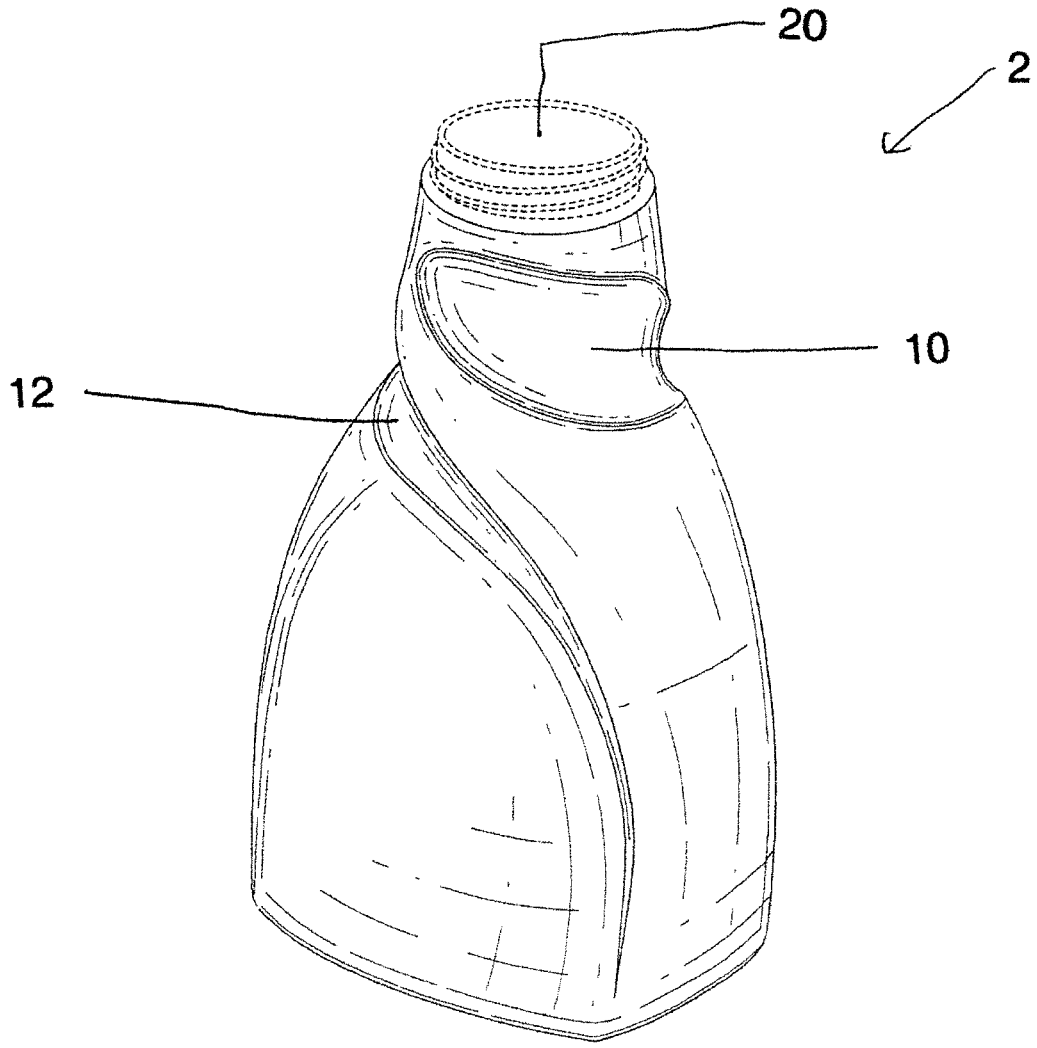
FIG. 1 of the drawings is an isometric view of the container having a first helical grip and a second helical grip.

While the specification concludes with the claims particularly pointing and distinctly claiming the invention, it is believed that the present invention will be better understood from the following description.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages and ratios used herein are by weight of the total composition and all measurements made are at 25° C., unless otherwise designated. An angular degree is a planar unit of angular measure equal in magnitude to 1/360 of a complete revolution.

All measurements used herein are in metric units unless otherwise specified.

It has now surprisingly been discovered that a container having an improved grip can be fabricated inexpensively, while maintaining the characteristics of being easy to manipulate and pour. Further, the container is formed such that it is easily scaleable to accommodate different internal volumes. The present invention solves these problems by the discovery of a container comprising a helical grip translating down the container.

While not wishing to be bound by theory, it is believed that the helical grip provides for an improved gripping area that conforms with the natural gripping pattern of the human hand. By having a helical gripping area conforming to the human hand, the consumer can better grip and manipulate the container, particularly when using one hand for controlling the container.

As used herein, "composition" refers to any material contained within the container. Compositions of this invention include fluids and fluidizable solids (solid particles small enough to pour in a fluid-like manner, such particles typically having an effective diameter of less than about 2.6 cm). These compositions are typically homogenous in nature; however, heterogeneous compositions and multiphase compositions are contemplated.

Container

The container refers to a hollow or partially hollow vessel capable of maintaining a composition for an indefinite period of time. The container may be free standing, substantially rigid, flexible and malleable, a malleable bag, a malleable sachet, a malleable pouch, and combinations of such forms. A preferred form is a free-standing container having an opening for pouring or dispensing a composition from the container under the influence of gravity. The container can be opened and closed repeatedly at the opening; however, containers that can only be opened once without resealing can likewise be utilized.

The dimensions of the container can be varied depending on end-use, and the size and shape of the container can be modified to incorporate different dimensions and features. One of ordinary skill in the art would readily know how to modify the container for a particular use. In one embodiment, the container has a volume from about 10 ml to about 5000 ml, in an alternate embodiment from about 100 ml to about 4000 ml, in another alternate embodiment from about 500 ml to about 3000 ml, and in another alternate embodiment from about 750 ml to 2250 ml. The container of the present invention is capable of housing any composition. One of ordinary skill in the art would know how to modify the shape, size, materials, and other properties of the container to properly contain any fluid.

The container of the present invention has an opening located substantially at the top of the container. The opening allows for the filling of the container and the dispensing of compositions from the container. In one embodiment, the opening of the container is removably sealable. Any sealing mechanism known in the art for removably sealing a container can be used. Such mechanisms include, but are not limited to, diaphragm valves, ball valves, slit valves, press taps, self-draining spouts, traditional spouts, divided spouts, screw caps, pull caps, snap caps, flip caps, vented caps, and combinations thereof.

In one embodiment, the container has a transition functionally attached to the opening. The transition is typically used to functionally connect a sealing mechanism to the container. Examples of transitions can be found U.S. Pat. No. 4,550,862, the entirety of which is incorporated herein by reference.

In a preferred embodiment the container is curved and shaped in such a manner that allows optimal draining with minimal residence time within the container. One way of achieving such a shape is to curve or bend at least the inner surface of the container in such a manner that the material within the container is directed out of the opening of the container. One of ordinary skill in the art would readily know how to shape the container to facilitate such draining characteristics.

Helical Grip

The helical grip of the present invention is functionally connected to the container wherein the helical grip extends at least partially down the container. The outer perimeter of the helical grip can have any desired shape, including rounded, jagged, patterned, smoothed, curved, and the like. The helical grip of the present invention can also vary in dimension. In one embodiment, the helical grip has a width that varies from about 1 mm to about 15 cm, alternatively from about 5 mm to about 12 cm, alternatively from about 1 cm to about 10 cm, alternatively from about 2 cm to about 8 cm, alternatively from about 2 cm to about 4 cm, alternatively from about 1 cm to about 3 cm. In an embodiment, the helical grip extends in a substantially helical pattern from an upper portion of the container to a lower portion of the bottle for at least about 180°, alternatively for at least about 215°, alternatively for at least about 270°. While a helical pattern can exist down the entire container, it is contemplated that only a portion of the helical grip translates down the container in a helical pattern.

In one embodiment, the helical grip of the present invention contains a textured region. Without wishing to be bound by theory, it is believed that the textured region increases the friction generated between the helical grip and the hand of the consumer, whereby improving the ability of the consumer to manipulate the container. In an embodiment, the entire surface of the helical grip contains a textured region. In another embodiment at least about 50% of the surface of the helical grip contains a textured region. Any mechanism for providing textured region to the helical grip is contemplated, including but not limited to, tape strips having backings suitable for gripping, ridged regions or dotted regions incorporated into the mold of the helical grip, coatings for the helical grip including rubberized coatings, and the like.

In another embodiment, the container of the present invention has one helical grip. In another helical embodiment, the container of the present invention has two helical grips. Containers having more than two helical grips are also contemplated. In one embodiment wherein the container has two helical grips, the helical grips are directly opposed on the container. By being directly opposed, the container can be manipulated from either side without having to rotate the container to obtain optimum gripping.

The helical grip can be formed in many different fashions, including, but not limited to, incorporating into molds for the container, laminating, scoring, etching, and the like. In an embodiment, the helical grip is incorporated into the molds for the container. In an alternate embodiment, the helical grip is incorporated into molds for blow-molding the container.

In one embodiment, the helical grip of the present invention translates down the container in a counterclockwise movement. In another embodiment, the helical grip of the present invention translates down the container in a clockwise movement. Alternatively, the helical grip translates up the container in either a counterclockwise or clockwise motion. In yet another embodiment, the helical grip is translated from one side of the container toward another side of the container in a counterclockwise or clockwise movement. Without wishing to be bound by theory, it is believed that the direction that the helical grip translates down the container can be associated with the left-handedness or right-handedness of a consumer. For example, consumers who want to manipulate the container with the right hand would receive the maximum benefit of a container wherein the helical grip translated down the container in a counterclockwise movement. While maximum benefits of the helical grip on the container are realized when using the proper hand with the proper helical grip translation, the helical grip maintains improved gripping regardless of the hand used to manipulate the container.

In one embodiment, the container tapers to form a neck at the opening. The neck of the container is ideally sized such that an adult person can grasp the neck of the bottle with one hand. In one embodiment, the neck has a cross-sectional area of from about 1 cm2 to about 100 cm2, alternatively from about 2 cm2 to about 90 cm2, alternatively from about 3 cm2 to about 80 cm2,alternatively from about 5 cm2 to about 70 cm2, alternatively from about 10 cm2 to about 60 cm2, alternatively from about 12 cm2 to about 40 cm2, alternatively from about 15 cm2 to about 30 cm2. In another embodiment, the neck has a cross-sectional area of less than about 30 cm2, alternatively less than about 25 cm2, alternatively less than about 20 cm2. Without wishing to be bound by theory, it is believed that the cross-sectional area of the neck in combination with the helical grip or grips of the present invention work together to substantially improve the maneuverability of the container by providing the user increased control of the container, even when manipulated with one hand.

In one embodiment a handle is used in conjunction with the container and helical grip. The handle provides an additional means of holding and/or gripping the container. While a handle can be used with smaller containers, it is particularly useful for containers with a volume of about 2 liters or more.

Materials

The container of this invention can be made of any material known by one of ordinary skill in the art capable of holding compositions in place for an indefinite period of time. While soft or nonrigid materials can be used; materials rigid enough to sit in a substantially upright position are preferred. Such materials include, but are not limited to, metals, woods, plastics, ceramics, and combinations thereof. Plastics are especially preferred. Preferable plastics include thermoform plastics and thermoset plastics. Such plastics include, but are not limited to high density polyethylene, polymethylmethacrylate, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof.

In a preferred embodiment, substantially clear plastics are used to form the container. Substantially clear plastics have a light transmission of at least about 70%, alternatively at least about 80%, and alternatively at least about 90%. The substantially clear plastics of this invention can optionally be colored or tinted in such a manner that the light transmission of the plastic is preserve. Polyethylene terephthalate is a non-limiting example of a plastic that can be made substantially clear. Likewise the materials may be processed in single or multiple layers. Because a variety of different materials may be used in the construction of the containers of the present invention the materials selected will be based on the intended end use and characteristics required of such a container It is readily known to one of ordinary skill in the art that the material used to form the container can possess a wide range of colors and hues. One of ordinary skill would readily know how to color and process the materials used to form the container to achieve any variations in color, as well as degrees of transparency including see-through clear, translucent, and opaque.

In another embodiment, it is envisioned that the container of this invention can be utilized with tag for electronic recognition systems. These tags, as used in the art, are used for various activities including identification, pricing, communication with a central database, communication with a centralized source for refilling and other purposes, and the like.

The formation of the container will vary according to the container material selected. In one embodiment, the container of the present invention is formed from a plastic. An exemplary way of forming a plastic is by blow-molding. By blow-molding, the container can be formed at a reduced cost and with the ideal minimum number of process operations. The container of this invention has proved to be as easy and simple to produce as an equivalent size container without the helical grips of the present invention, with no increase in material and process time. While blow-molding can be used to produce the container of the present invention, other methods, including other blow-molding variants, can be used.

In yet another embodiment, the container of the present invention contains instructions for communicating with a consumer. The instructions can be printed directly on the container or can be placed on the container in the form of a label. One of ordinary skill in the art would readily know how to print instructions on a container made from a particular material. Likewise, one of ordinary skill in the art would readily know how to affix or attach a label to a container. In a preferred embodiment, the label spans the circumference of the container.

Compositions

While any composition can be used with the container of this invention, the containers of this invention are particularly suited to laundry care compositions, including laundry detergents, laundry softeners, laundry treatment compositions and the like. Particularly well suited are liquid compositions suited for laundry care compositions. Examples of such compositions are included in U.S. Provisional Application No. 60/554,692, hereby incorporated by reference.

Without being bound by theory, it is believed that these compositions are better controlled when utilized with the containers of this invention due to the increased ability to grip the container. It is believed that the effect of the improved grip increases the amount of container and/or composition weight that can be manipulated by a user. Further, the improved grip increases the ability of the user to manipulate the container when compositions and/or other materials are present on the outside of the container.

In one embodiment, the composition of the invention can be transparent, translucent, or opaque. In a more preferred embodiment, the transparent, translucent, or opaque composition is colored such that the color or hue is visible from within the container. In an even more preferred embodiment, the container of the present invention is colored in such a manner that it enhances the visual appeal of the transparent or translucent composition. In a non-limiting example, the container of the present invention is made from a blue polyeth ylene terephthalate polymer and contains a blue opaque composition. Such combinations of colored containers and colored compositions unexpectedly produce visually dynamic, quasi-fluorescent effects.

EXAMPLE

Figure 2:
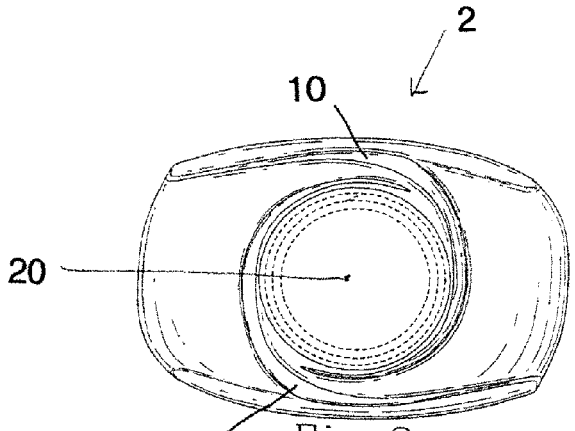
FIG. 2 is a top view of the container having a first helical grip and a second helical grip.
Figure 3:
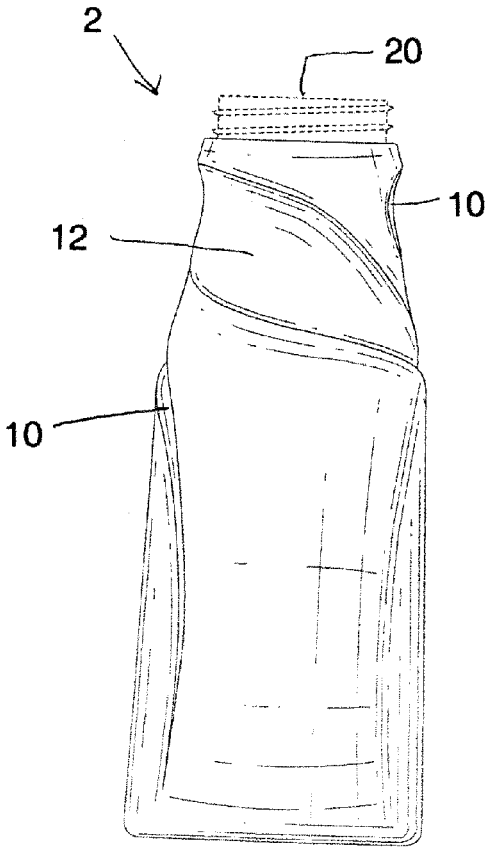
FIG. 3 is a left side view of the container having a first helical grip and a second helical grip.
Figure 4:
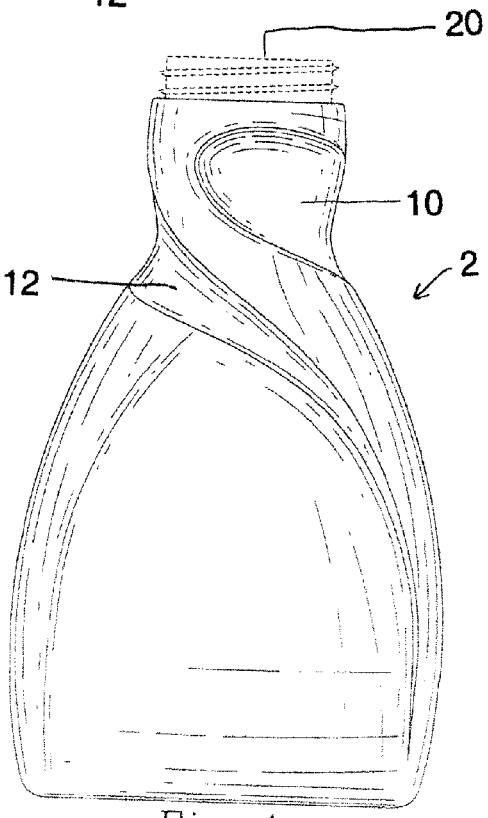
FIG. 4 is a frontal view of the container having a first helical grip and a second helical grip.
Figure 5:
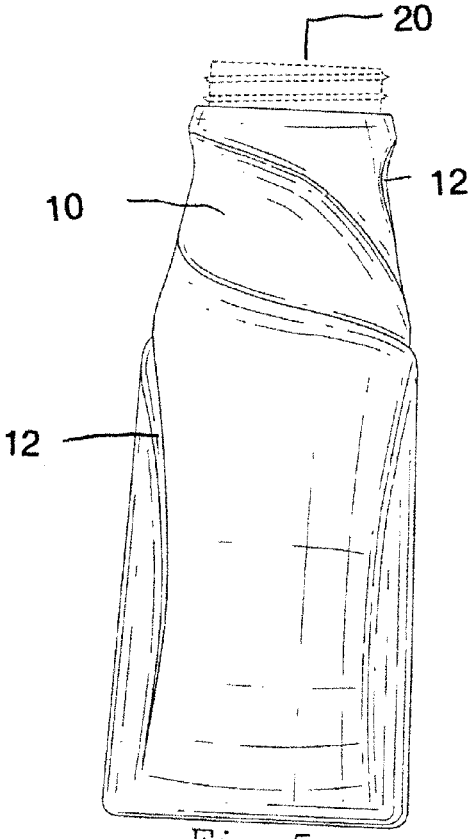
FIG. 5 is a right side view of the container having a first helical grip and a second helical grip.
Figure 6:
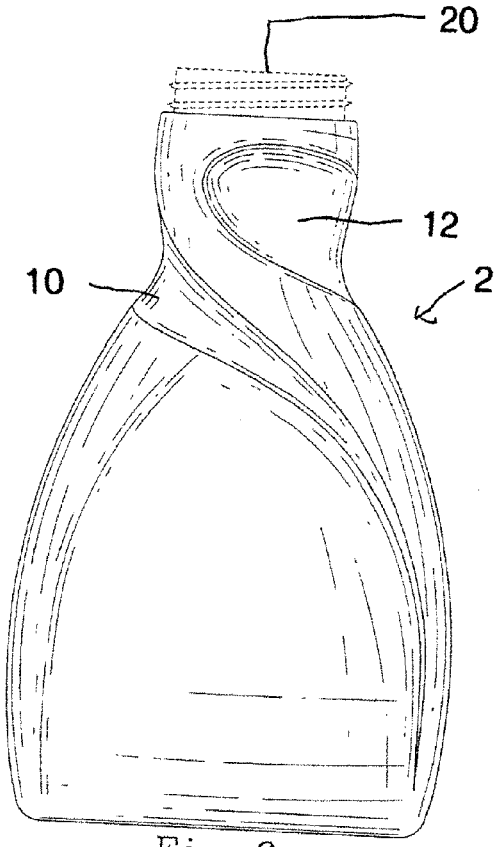
FIG. 6 is a rear view of the container having a first helical grip and a second helical grip.
Figure 7:
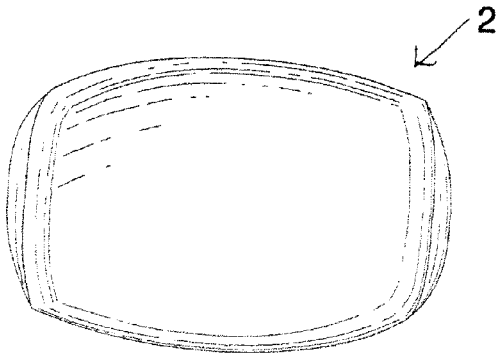
FIG. 7 is a bottom view of the container having a first helical grip and a second helical grip.

A preferred container is illustrated in the appended FIGS. 1-7. In these figures, a container 2 is illustrated having an opening 20, a first helical grip 10 and a second helical grip 12. The first helical grip 10 and the second helical grip 12 translate down this container. As is apparent from FIG. 2, the first helical grip 10 and the second helical grip 12 are directly opposing each other. The first helical grip 10 and the second helical grip 12 translate down the container in a counterclockwise movement.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited are, in relevant part, incorporated herein by reference; the citation of any document is not to be construed as an admission that it is prior art with respect to the present invention.

What is claimed is:

1. A fabric softener product comprising:

(a) a plastic container; and (b) a fabric softener composition contained in said plastic container;

wherein said plastic container has a neck having a cross-sectional area from about 12 $cm^2$ to about 40 $cm^2$;

wherein said container has a volume of from about 100 mL to about 4000 mL;

wherein said container comprises a helical grip extending at least partially down the container;

wherein said helical grip has a width from about 1 mm to about 15 cm; and wherein said helical grip extends in a substantially helical pattern from an upper portion of the container to a lower portion of the container for at least about 180 degrees.

2. The product of claim 1, wherein the plastic is selected from high density polyethylene, polymethylmethacrylate, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof.

3. The product of claim 2, wherein the plastic is polyethylene terephthalate.

* * * * *